US007064286B2

(12) United States Patent
Dumont et al.

(10) Patent No.: US 7,064,286 B2
(45) Date of Patent: Jun. 20, 2006

(54) SECURE OPERATION MECHANISM FOR ELECTRICAL SHUTDOWN DEVICE AND DEVICE EQUIPPED WITH SUCH A MECHANISM

(75) Inventors: Roger Dumont, Benfeld (FR); Régis Heymann, Colmar (FR)

(73) Assignee: Socomec, S. A., Benefeld (FR)

( * ) Notice: Subject to any disclaimer, the term of this patent is extended or adjusted under 35 U.S.C. 154(b) by 113 days.

(21) Appl. No.: 10/822,915

(22) Filed: Apr. 13, 2004

(65) Prior Publication Data

US 2005/0205403 A1 Sep. 22, 2005

(30) Foreign Application Priority Data

Mar. 18, 2004 (FR) ..... 04 02829

(51) Int. Cl.
*H01H 17/00* (2006.01)

(52) U.S. Cl. ..... 200/331; 200/43.14; 200/50.1; 335/68; 335/72

(58) Field of Classification Search ..... 200/331, 200/332, 50.05, 50.12–50.13, 50.1, 43.01–43.02, 200/43.14, 43.16; 335/68–72
See application file for complete search history.

(56) References Cited

U.S. PATENT DOCUMENTS 4,612,424 A * 9/1986 Clark et al. ..... 200/50.18
5,272,296 A * 12/1993 Robarge et al. ..... 200/331
5,577,603 A * 11/1996 Bogdanovs et al. ..... 200/331
5,857,563 A * 1/1999 Helmer et al. ..... 200/332.1

* cited by examiner

*Primary Examiner*—K. Richard Lee
(74) *Attorney, Agent, or Firm*—Davis & Bujold, P.L.L.C.

(57) ABSTRACT

This invention pertains to a simple, economical, reliable secure operation mechanism that can be adapted to factory production, or for post-sale, on any electrical shutdown device in a cabinet, that is designed to enable the shutdown device to be switched, while the cabinet is open, only after an additional voluntary action is performed by the operator on a secondary handle provided inside said cabinet.

The shutdown device (1) is characterized in that it has a secure operation mechanism (10) equipped with a secondary handle (11) attached to the control shaft (6) that is accessible from inside the cabinet (4), a return mechanism (13) that moves the control shaft (6) toward the door (5), a padlocking plate (14) lengthened by a stub (15) that is mounted on the control shaft (6) under the secondary handle (11) and a plate (17) connected to one lateral surface of the shutdown device (1) that has an opening (18) througch which the stub (15) passes, and that defines a lock zone (18*a*) preventing the shutdown device (1) from switching, and an unlock zone (18*b*) that enables this switching.

16 Claims, 5 Drawing Sheets

A
B
C
D
1
2
3
4
6
8
10
11
12
13
14
14a
15
16
17
18
18a
18b

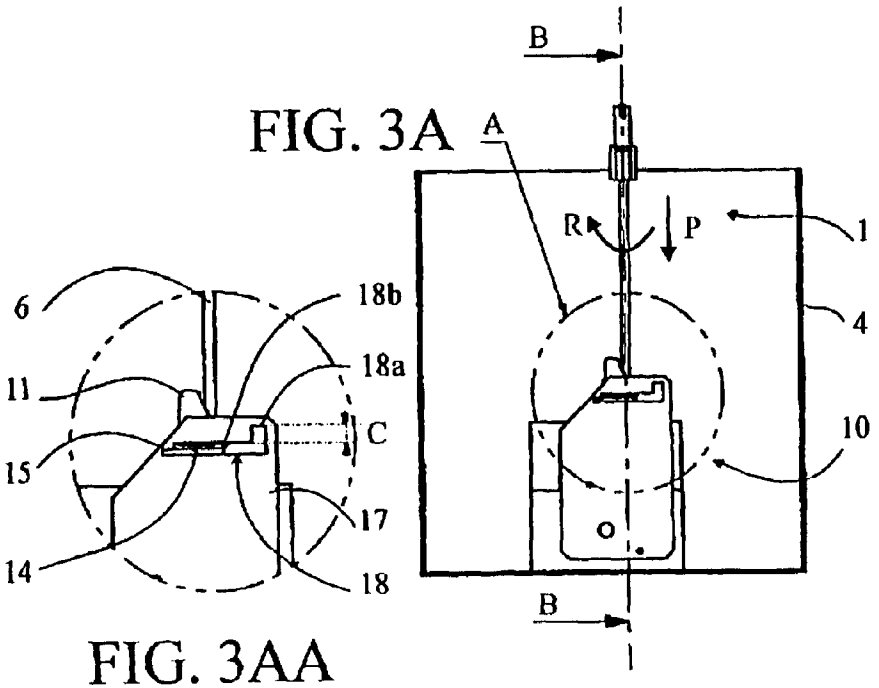
FIG. 3A
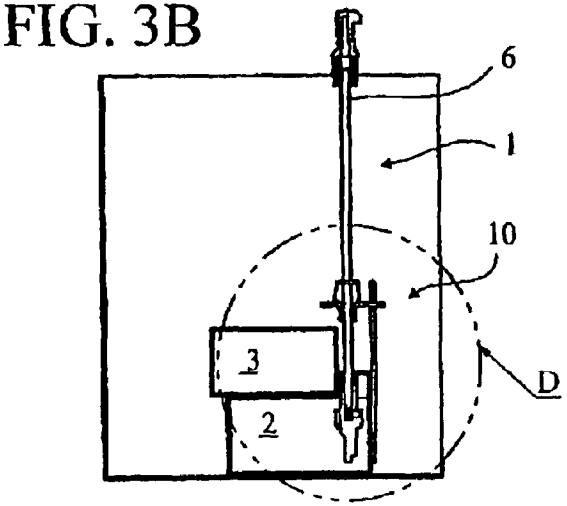
FIG. 3B
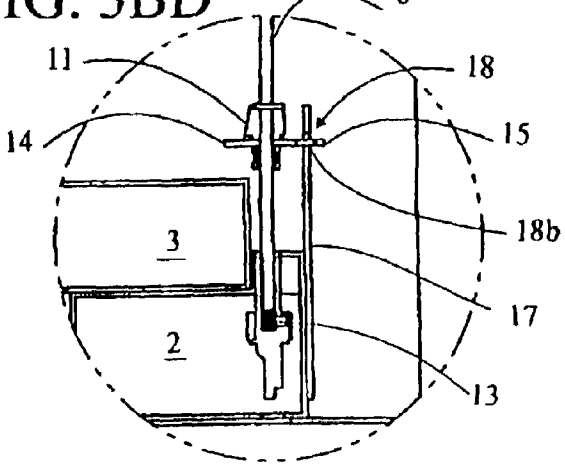
FIG. 3BD
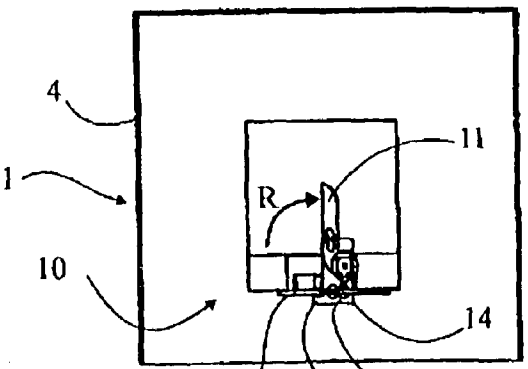
FIG. 3AA
FIG. 3C

SECURE OPERATION MECHANISM FOR ELECTRICAL SHUTDOWN DEVICE AND DEVICE EQUIPPED WITH SUCH A MECHANISM

This application claims foreign priority under 35 U.S.C. §119 of French Patent Application FR 04/02829 filed Mar. 18, 2004.

FIELD OF THE INVENTION

This invention pertains to a secure operation mechanism for an electrical shutdown device, intended to be housed in a cabinet that is closed by a door, and this shutdown device can be switched between a disengaged position (0 position) and an engaeed position (1 position) by shifting a control shaft with a "principal" handle mounted on said door such that it is accessible from the outside of said cabinet when said door is in the closed position. This invention also pertains to an electrical shutdown device equipped with this kind of secure operation mechanism.

BACKGROUND OF THE INVENTION

The technical aspect of the invention pertains to shutdown devices for low-voltage electrical networks, such as switches, fuse switches, circuit breakers and any other shutdown device, housed either in one individual cabinet per device, in a single cabinet for several devices, or in an electrical equipment cabinet. Switching these shutdown devices from the 0 position (disengaged) to the 1 position (engaged) is done manually using a "principal" handle that is accessible from the outside of the cabinet, on the front surface, mounted on the door, with a control shaft, generally a square-shaped shaft, which passes through this door to transfer the shifting movement from the handle to the control mechanism of the shutdown device. In general, this type of cabinet can only be opened by qualified, skilled personnel authorized to operate the shutdown devices in case of a breakdown or for maintenance purposes. When the cabinet is open, the qualified member of personnel may need to switch the shutdown device from the 0 position to the 1 position and vice versa. However, in order to flip this switch, he can no longer use the principal handle, which is removed from the control shaft, since the handle is mounted on the door. He would then either use a secondary handle provisionally mounted on the control shaft, or any kind of tool such as pliers or a similar tool to move the control shaft. These operations, conducted in an improvised, non-secure manner on a live shutdown device, represent a significant risk of electric shock for the operation personnel.

The standards in force are changing and some standards notably stipulate the ability to operate the shutdown device, while the cabinet is open, using an additional voluntary action performed by the operation personnel on a secure operation mechanism, that is made available inside the cabinet, this additional voluntary action being intended to avoid any accident and in particular, accidentally switching the shutdown device.

SUMMARY OF THE INVENTION

This invention is intended to offer a technical solution in response to this change in these standards by proposing a simple, economical, reliable, adaptable operating mechanism on any shutdown device, which can also be offered post-sale to equip shutdown devices that are already in service, since this secure operation mechanism is constructed to make it possible to switch the shutdown device, while the door is open, in complete security, by including this notion of an additional voluntary action, as required by the standards.

For this purpose, the invention pertains to a secure operating mechanism of the kind described in the introduction, characterized in that it includes at least one "secondary" handle intended to be attached to said control shaft in such a way as to be accessible from the inside of said cabinet in order to switch said shutdown device between its 0 and 1 positions when said cabinet is open, and with a locking method on said control shaft that is constructed to be able to be moved between at least one locked position, in which the switching of said shutdown device is prevented, and one unlocked position, in which switching is enabled.

This locking method is advantageously constructed to change from the locked to the unlocked position through a manual action performed on the secondary handle, in order to move the control shaft along an axis over at least one predefined distance and to return from the unlocked position to the locked position automatically through the action of a return mechanism that acts on the control shaft, and this return mechanism is to be mounted along the axis of said control shaft. The locking method can include at least one fixed locking mechanism, to be mounted on the shutdown device, and one mobile locking mechanism, to be mounted on the control shaft to extend in the direction of said fixed locking mechanism and to operate in conjunction with this fixed locking mechanism at least in the locked position.

In its preferred form of construction, the fixed locking mechanism has a plate equipped with at least one opening, defining at least one lock zone and at least one unlock zone, and the mobile locking mechanism has at least one stub that can be lodged in the lock zone to prevent the control shaft from being switched and to rotate in the unlock zone to enable switching.

The lock zone preferably extends roughly parallel to the control shaft over a length that determines said distance C and the unlock zone extends roughly perpendicular to this control shaft on a length corresponding at least to the angular displacement followed by this control shaft when switching the shutdown device.

The mobile locking mechanism has a plate that is lengthened by said stub, and this plate can have at least one opening constructed to receive at least one padlock, making it possible to lock the shutdown device in its 0 position.

For this purpose, the invention also pertains to an electrical shutdown device of the kind described in the introduction, characterized in that it has a secure operation mechanism as defined above.

BRIEF DESCRIPTION OF THE DRAWINGS

This invention and its advantages will be clearer in the following description of two methods of construction, provided as an example and not as an exhaustive list, in reference to the attached illustrations, in which.

DETAILED DESCRIPTION

Figure 1B:
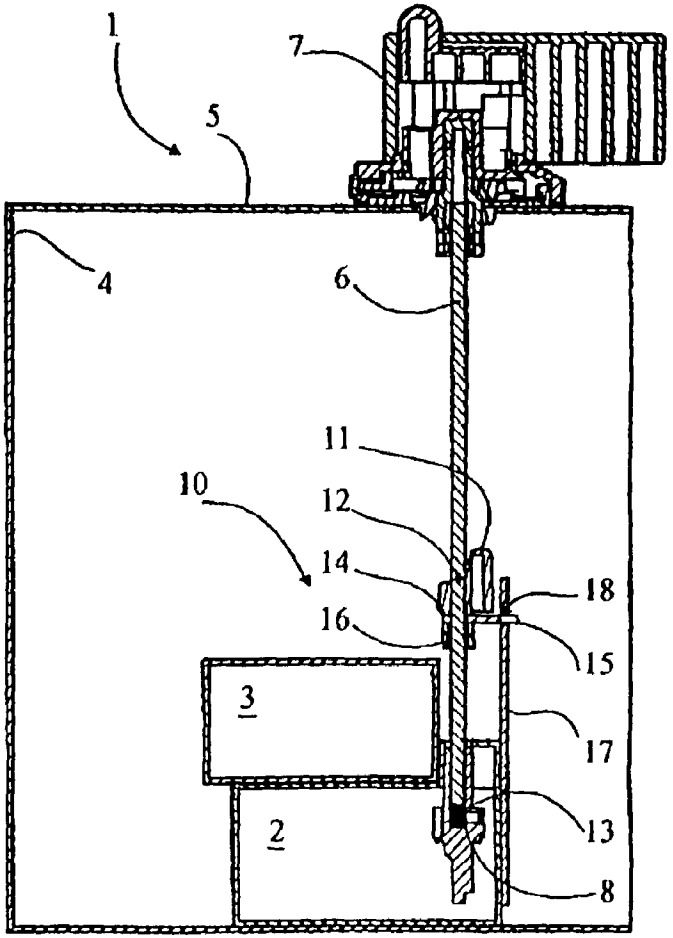
FIG. 1B is a cross section view [BB] of the device depicted in FIG. 1A, FIGS. 2A and 2B are similar views to FIGS. 1A and 1B, with the cabinet open and the shutdown device in the 0 position.

In reference to the figures, the secure operation mechanism [10, 10'] according to the invention is not illustrated alone, but directly mounted on two different electrical shutdown devices [1, 1'], a low-caliber shutdown device [1] (up to 30 amp) illustrated in FIGS. 1 to 3 and a shutdown device [1'] of a higher caliber (above 30 amp) illustrated in FIGS. 4 and 5. Due to its simplicity and ease of assembly, this secure operation mechanism [10, 10'] can be offered both as separate components to equip existing shutdown devices [1, 1'] and as original components to equip shutdown devices [1, 1'] as they are being manufactured.

In reference to FIGS. 1 to 3, the shutdown device [1] is depicted in the 0 position in a closed cabinet, in the 0 position in an open cabinet, and then in the 1 position in an open cabinet, respectively. Because this shutdown device [1] is well-known by experts in the field, it is not described in more detail. It is illustrated by a first rectangle symbolizing its shutdown module [2] and by a second rectangle symbolizing its optional fuse block [3], and the ensemble is housed in a cabinet [4] equipped with a door [5] such as, for example, a door mounted on hinges or similar devices. It is controlled by shifting a control shaft [6] extending from the shutdown module [2] through the door [5] to be attached to a "principal" handle [7] mounted on this door [5] so as to be accessible from outside the cabinet [4] for switching the shutdown device [1] between its 0 and 1 positions while the door [5] is in the closed position.

This shutdown device [1] is equipped with a secure operation mechanism [10] according to the invention, including:

- a "secondary" handle [11] positioned on the inside of the cabinet [4], removed from the door [5], and attached to the control shaft [6] by a pin [12] for example, or any other equivalent means,
- a return mechanism [13] such as a compression spring mounted along the axis of the control shaft [6], in its case [8] provided in the shutdown device [1], to move it in the direction of the door [5],
- a plate, which can be a padlocking plate [14], lengthened by a stub [15] and mounted on the control shaft [6], under the secondary handle [11] and blocked along its axis by a stop sleeve [16] attached to the control shaft [6] by a radial screw (not illustrated), for example, or any other equivalent means,
- a plate [17] connected to a side surface of the shutdown mechanism [1] that has an opening [18] that is traversed by said padlocking plate [14] and/or said stub [15] depending on the position of the secondary handle [11].

The opening [18] of the plate [17] and the stub [15] of the padlocking plate [14] operate together to form the locking method created to enable the engagement (1 position) of the shutdown device [1], when the door [5] is open, only if the operating personnel performs an additional voluntary action on the secondary handle [11], which is, in this case, a push in direction P to move the control shaft [6] along the axis over a predetermined distance C, before moving it in direction R, generally a quarter turn, to do the switching. The opening [18] provided in the plate [17] consists of a slot in the shape of a flattened L. The short leg of this L-shaped slot is parallel to the control shaft [6] and defines a lock zone [18*a*] in which the stub [15] is lodged to prevent the control shaft [6] from shifting when the shutdown device [1] is in the 0 position and the cabinet [4] is open. The long leg of this L-shaped slot is perpendicular to the control shaft [6] and defines an unlock zone [18*b*] in which the stub [15] rotates freely to enable the switching of the shutdown device [1] either when the door [5] is closed, by moving the principal handle [7], or when the door [5] is open, by a combined movement: a movement in direction P followed by a movement in direction R of the secondary handle [11]. The depth of the lock zone [18*a*] determines the distance C which corresponds to the axial movement that must be made by the stub [15], and therefore the control shaft [6], in order to move from the locked to the unlocked position and vice versa. The padlocking plate [14] has openings [14*a*] to hold at least one padlock (not illustrated) making it possible to lock the shutdown device [1] in the 0 position.

The functioning of this secure operation mechanism [10] is described in detail in reference to FIGS. 1 through 3.

Figure 1A:
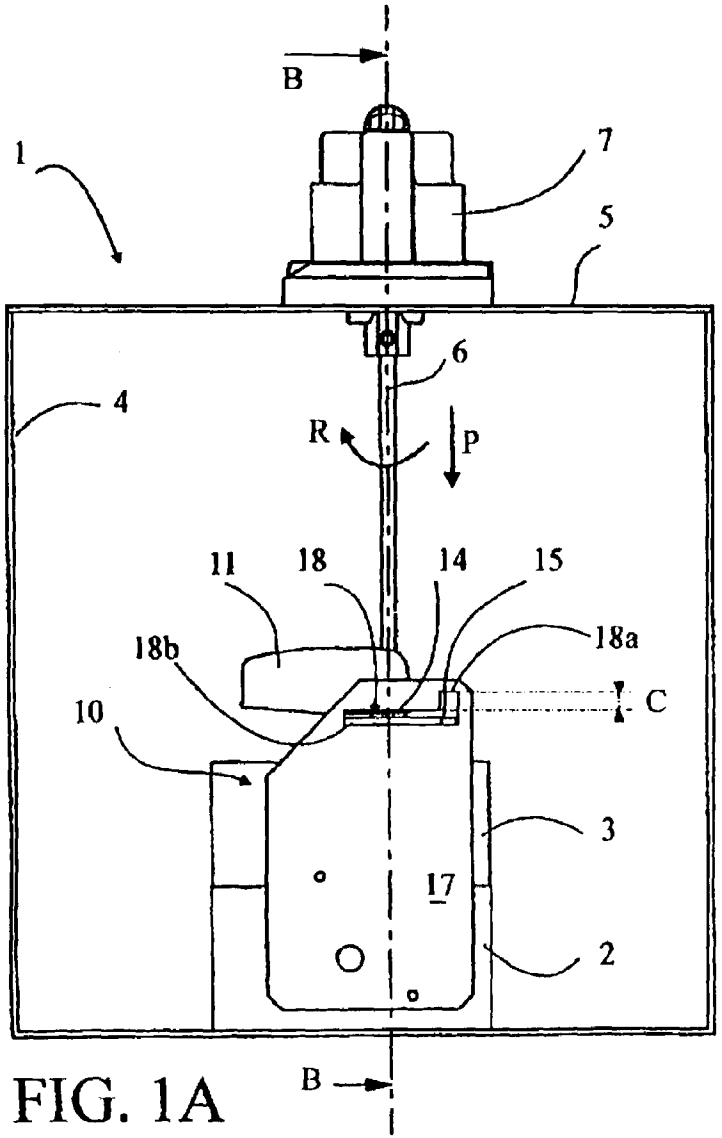
FIG. 1A represents a shutdown device according to the invention, equipped with a secure operation mechanism, housed in a closed cabinet, viewed from the side, with the side wall of the cabinet removed.

In FIGS. 1A and 1B, the shutdown device [1] is in the 0 position, the door [5] is in the closed position, and the principal handle [7] is attached to the control shaft [6] by pushing the latter in direction P against the return mechanism [13]. The length of the control shaft [6] is set so that, when the door [5] is closed, the control shaft [6] moves along the axis by a distance that is at least equal to C, thereby releasing the stub [15] from the lock zone [18*a*] and enabling the padlocking plate [14] to rotate in the unlock zone [18*b*] of the plate [17]. The secure operation mechanism [10] is in the unlocked position, in which it allows the shutdown device [1] to be switched freely by moving the principal handle [7] in direction R, provided that the shutdown device [1] was not locked in the 0 position by a padlock through the padlocking plate [14].

Figures 2A, 2B, 2C:
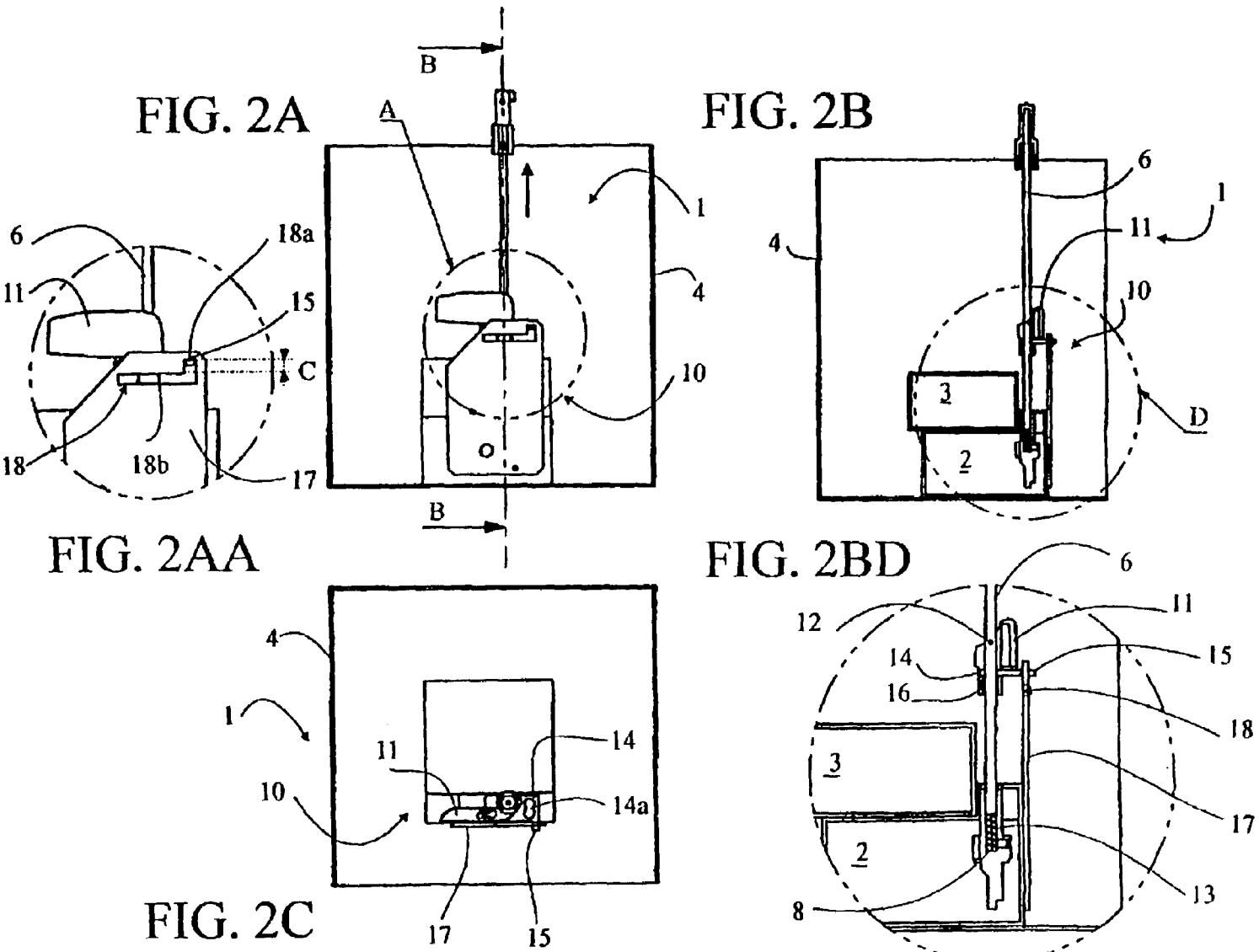
FIG. 2C is a view from above, and FIGS. 2AA and 2BD are enlarged views of details A and D, FIGS. 3A–C, 3AA and 3BD are similar views to FIGS. 2A–C, 2AA and 2BD, with the cabinet open, and with the shutdown device in the 1 position.
Figure 4B:
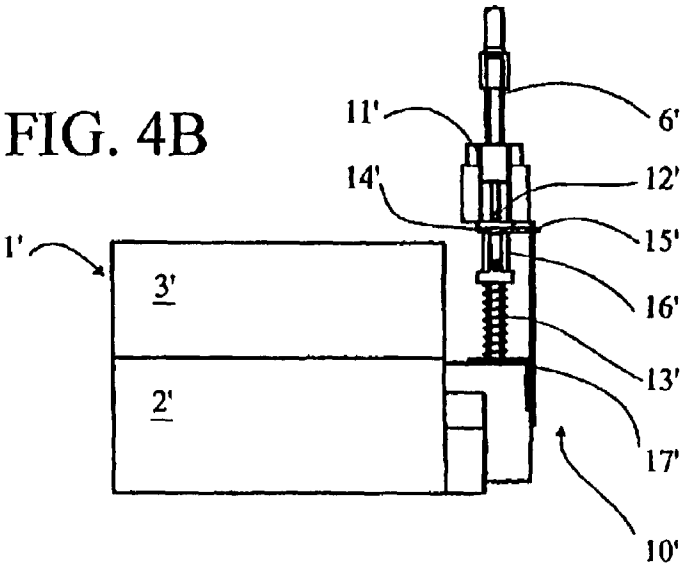
FIGS. 4A–C are similar views to FIGS. 2A–C of another shutdown device according to the invention, with the cabinet open and the shutdown device in the 0 position, FIG. 4AA is an enlarged view of detail A, and FIGS. 5A–C and 5AA are similar views to FIGS. 4A–C and 4AA, with the cabinet open and the shutdown device in the 1 position.
Figure 4A:
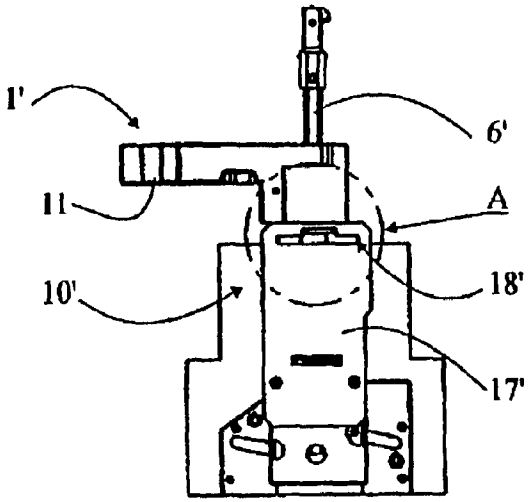
Figure 4C:
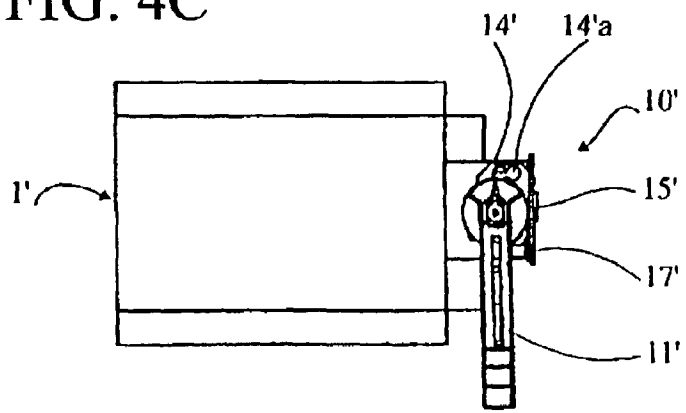
Figure 4A:
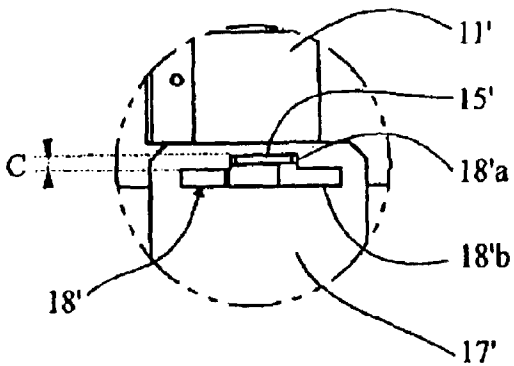
Figure 5B:
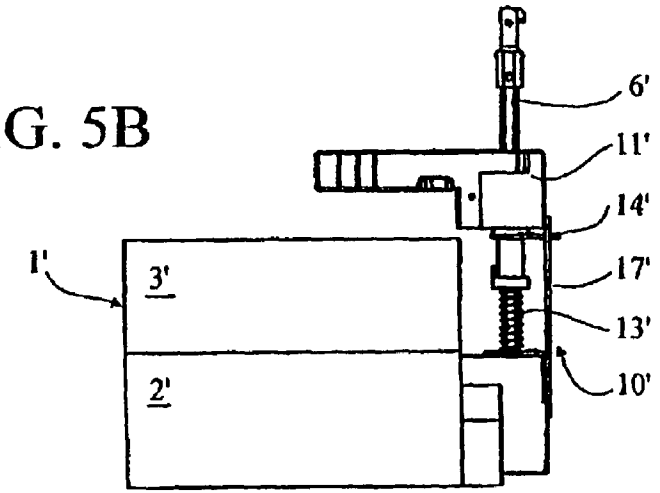
Figure 5C:
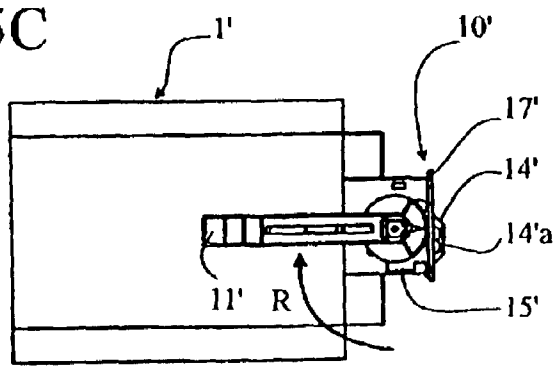
Figure 5A:
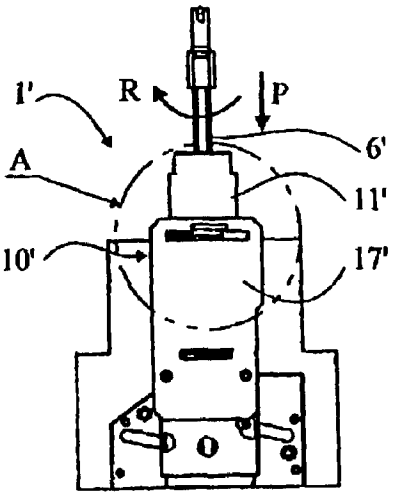
Figure 5A:
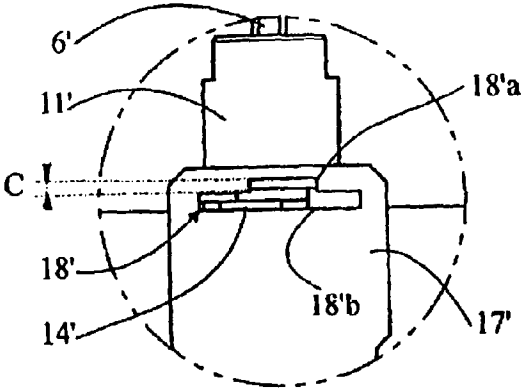

In FIGS. 2A–2C, the shutdown device [1] is in the 0 position, the door [5] is open, and the principal handle [7] is detached from the control shaft [6]. This control shaft [6] has automatically moved a distance at least equal to C in the opposite direction of P propelled by the action of the return mechanism [13], placing the stub [15] into the lock zone [18*a*]. The secure operation mechanism [10] is in the locked position, in which the shutdown device [1] is prevented from being switched by simply moving the secondary handle [11] in direction R.

In FIGS. 3A–3C, the door [5] is always in the open position and the shutdown device [1] is switched into the 1 position. In order to be able to switch this shutdown device [1] from its 0 position (see FIG. 2A–2C) to its 1 position, an operator pushed the secondary handle [11] along direction P, moving the control shaft [6] against the return mechanism [13] by a distance at least equal to C to release the stub [15] from the lock zone [18*a*]. He then moved this secondary handle [11] in direction R by approximately ¼ turn to switch the shutdown device [1] from its 0 position to its 1 position, where the stub [15] and the related padlocking plate [14] can rotate freely in the unlock zone [18*b*]. In this position, the openings [14*a*] of the padlocking plate [14] are no longer accessible.

In this state, the operator can either close the door [5] again, whereby the principal handle [7] will once again attach to the corresponding end of the control shaft [6], or he can leave the cabinet [4] open and switch the shutdown device [1] into the 0 position. In order to do this, all he has to do is push the secondary handle [11] in the opposite direction of R approximately ¼ turn and then release it again. The control shaft [6] automatically travels back by a distance at least equal to C, propelled by the return mechanism [13], releasing the stub [15] in the lock zone [18*a*] and restoring the secure operation mechanism [10] to the locked position, thus making it impossible to involuntarily switch the shutdown device [1]. Therefore, the operator no longer needs to perform this additional voluntary action to engage the shutdown device [1]. This is an emergency safety measure enabling the operator to disengage the shutdown device [1] very quickly by a simple action.

FIGS. 4 and 5 illustrate another shutdown device [1'] that is also equipped with a secure operation mechanism [10'] according to the invention, which is illustrated in the 0 position and in the 1 position respectively, with the door in the open position. In these figures, neither the cabinet, nor the door is illustrated, and the components bear the same reference numbers as in the previous example, these numbers being differentiated by an apostrophe. Because the description and the functioning of this secure operation mechanism [10'] are similar to the previous example, they will not be repeated. One of the construction differences is based on the assembly of the return mechanism [13'] which is positioned along the same axis as the control shaft [6'] but positioned around this control shaft [6'], between the shutdown module [2'] and the stop sleeve [16'] of the secure operation mechanism [10']. Another construction difference is based on the opening [18'] which is a slot in the shape of an inverted T, where the vertical bar defines the lock zone [18'*a*] and the horizontal bar defines the unlock zone [18'*b*].

This description highlights the simplicity of the invention's secure operation mechanism [10, 10']. It consists of a very small number of components, and these components are easy to produce. This design makes the secure operation mechanism [10, 10'] inexpensive and able to be easily offered as an addition to previously sold items.

This invention is not limited to the construction examples described herein; rather, it is extended to cover any modification and variation that is obvious for an expert in the field, while remaining within the scope of protection defined in the claims appended hereto.

The invention claimed is:

1. A secure operation mechanism (10, 10') for an electrical shutdown device (1, 1') housed within a cabinet (4) which is closed by a door (5), the shutdown device (1, 1') being moveable between a disengaged position (0 position) and an engaged position (1 position) by shifting of a control shaft (6, 6') attached to a principal handle (7) mounted to the door (5) so as to be accessible from outside the cabinet (4) when the door (5) is closed:

wherein the secure operation mechanism (10,10') comprises a secondary handle (11, 11') attached to the control shaft (6, 6') so as to be accessible from inside the cabinet (4) in order to switch the shutdown device (1, 1') between the disengaged and the engaged positions (0 and 1 positions) when the door (5) is open, and a locking mechanism is attached to the control shaft (6, 6') and is positioned to be moveable between a locked position, in which the locking mechanism prevents switching of the shutdown device (1, 1') via movement the secondary handle (11, 11') when the door (5) is open, and an unlocked position, in which switching of the shutdown device (1, 1') is permitted via a pushing movement of the secondary handle (11, 11'), when the door (5) is open, and via a corresponding pushing movement of the principal handle (7), when the door (5) closed.

2. A secure operation mechanism (10, 10') for an electrical shutdown device (1, 1') housed within a cabinet (4) which is closed by a door (5), the shutdown device (1, 1') being moveable between a disengaged position (0 position) and an engaged position (1 position) by shifting of a control shaft (6, 6') attached to a principal handle (7) mounted to the door (5) so as to be accessible from outside the cabinet (4) when the door (5) is closed;

wherein the secure operation mechanism (10,10') comprises a secondary handle (11, 11') attached to the control shaft (6, 6') so as to be accessible from inside the cabinet (4) in order to switch the shutdown device (1, 1') between the disengaged and the engaged positions (0 and 1 positions) when the door (5) is open, and a locking means is attached to the control shaft (6,6') and is positioned to be moveable between a locked position and an unlocked position; and the locking means moves between the locked position to the unlocked position, when the door (5) is open, by manual action of the secondary handle (11, 11') and the control shaft (6, 6') a predefined distance (C) along direction (P) and returns from the unlocked position to the locked position automatically through action of a return mechanism (13, 13') acting on the control shaft (6, 6').

3. The secure operation mechanism of claim 2, wherein the locking means has at least one fixed locking mechanism mounted on the shutdown device (1, 1') and a mobile locking mechanism mounted on the control shaft (6,6') so as to extend in a direction of the fixed locking mechanism and operate in conjunction with mobile locking mechanism, at least in the locked position.

4. The secure operation mechanism of claim 3, wherein the fixed locking mechanism includes a plate (17, 17') with at least one opening (18, 18') defining at least one lock zone (18*a*, 18'*a*) and at least one unlock zone (18*b*, 18'*b*) and the mobile locking mechanism has at least one stub (15, 15') that engages with the lock zone (18*a*, 18'*a*) to prevent the control shaft (6, 6') from being switched, and is rotatable in the unlock zone (18*b*, 18'*b*) to enable switching of the control shaft (6, 6').

5. The secure operation mechanism of claim 4, wherein the lock zone (18*a*, 18'*a*) extends substantially parallel to the control shaft (6, 6') for a length which determines the predefined distance (C) and the unlock zone (18*b*, 18'*b*) extends substantially perpendicular to the control shaft (6,6') for a length corresponding at least to an angular displacement followed by the control shaft (6, 6') when switching the shutdown device (1, 1').

6. The secure operation mechanism of claim 4, wherein the mobile locking mechanism has a plate (14, 14') that is lengthened by the stub (15, 15').

7. The secure operation mechanism of claim 6, wherein the plate (14, 14') has at least one opening (14*a*, 14'*a*) positioned to receive at least one padlock for locking the shutdown device (1, 1') in the disengaged position (0 position).

8. The secure operation mechanism of claim 2, wherein the return mechanism (13) is mounted along an axis of the control shaft (6).

9. An electrical shutdown device (1, 1') housed within a cabinet (4), which is dosed by a door (5), the shutdown device (1, 1') being moveable between a disengaged position (0 position) and an engaged position (1 position), the shut down device comprising a control shaft (6, 6') attached to a principal handle (7) mounted on the door (5) so as to be accessible from outside the cabinet (4) when the door (5) is closed;

wherein the electrical shutdown device (1, 1') includes a secure operation mechanism (10, 10') equipped with a secondary handle (11, 11') attached to the control shaft (6, 6') so as to be accessible from inside the cabinet (4) for switching the shutdown device (1, 1') between the disengaged and the engaged positions (0 and 1 positions) when the door (5) is open, and a locking means attached to the control shaft (6, 6') and positioned to be moveable between a locked position, in which the locking means prevents switching of the shutdown device (1, 1') via movement the secondary handle (11, 11') when the door (5) is open, and an unlocked position, in which switching of the shutdown device (1, 1') is permitted via a pushing movement of the secondary handle (11, 11'), when the door (5) is open, and via a corresponding pushing movement of the principal handle (7), when the door (5) closed.

10. The shutdown device of claim 9, wherein the locking means moves between the locked position, to the unlocked position when the door (5) is open, by manual action of the secondary handle (11, 11') and the control shaft (6, 6') a predefined distance (C) along direction (P) and returns from the unlocked position to the locked position automatically through action of a return mechanism (13, 13') acting on the control shaft (6, 6').

11. The shutdown device of claim 10, wherein the locking means includes at least one fixed locking mechanism mounted to the shutdown device (1, 1') and at least one mobile locking mechanism mounted to the control shaft (6, 6') so as to extend in a direction of the fixed locking mechanism and operate in conjunction with the mobile locking mechanism, at least in the locked position.

12. The shutdown device of claim 11, wherein the fixed locking mechanism includes a plate (17, 17') with at least one opening (18, 18') defining at least one lock zone (18*a*, 18*a*) and at least one unlock zone (18*b*, 18'*b*); and the mobile locking mechanism has at least one stub (15, 15') that engages with the lock zone (18*a*, 18'*a*) to prevent the control shaft (6, 6') from switching, and is rotatable in the unlock zone (18*b*, 18'*b*) to enable switching of the control shaft (6, 6').

13. The shutdown device of claim 12, wherein the lock zone (18*a*, 18'*a*) extends substantially parallel to the control shaft (6, 6') for a length which determines the distance (C), and the unlock zone (18*b*, 18'*b*) extends substantially perpendicular to the control shift (6, 6') for a length corresponding at least to an angular displacement followed by the control shaft (6, 6') for switching of the shutdown device (1, 1').

14. The shutdown device of claim 12, wherein the mobile locking mechanism has a plate (14, 14') that is lengthened by the stub (15, 15').

15. The shutdown device of claim 14, wherein the plate (14, 14') has at least one opening (14*a*, 14'*a*) positioned to receive at least one padlock for looking the shutdown device (1, 1') in the disengaged position (0 position).

16. The shutdown device of claim 10, wherein the return mechanism (13) is mounted along an axis of the control shaft (6).

* * * * *